US009894951B2

(12) United States Patent
Alex

(10) Patent No.: US 9,894,951 B2
(45) Date of Patent: Feb. 20, 2018

(54) HAIR BAND

(71) Applicant: Gunter Alex, Deutschland (DE)

(72) Inventor: Gunter Alex, Deutschland (DE)

( * ) Notice: Subject to any disclaimer, the term of this patent is extended or adjusted under 35 U.S.C. 154(b) by 190 days.

(21) Appl. No.: 15/006,218

(22) Filed: Jan. 26, 2016

(65) Prior Publication Data

US 2017/0208884 A1 Jul. 27, 2017

(51) Int. Cl.

| | |
|---|---|
| ***A41G 5/00*** | (2006.01) |
| ***A45D 8/36*** | (2006.01) |
| *A45D 8/00* | (2006.01) |

(52) U.S. Cl.

CPC ..... *A41G 5/0073* (2013.01); *A41G 5/0046* (2013.01); *A45D 8/36* (2013.01); *A45D 2008/004* (2013.01)

(58) Field of Classification Search

CPC ..... A41G 5/00; A41G 5/004; A41G 5/0073; A41G 5/0046; A45D 8/36

See application file for complete search history.

(56) References Cited

U.S. PATENT DOCUMENTS

| | | | | |
|---|---|---|---|---|
| 3,280,826 | A | 10/1966 | Jenkins | |
| 4,599,749 | A | 7/1986 | Childs et al. | |
| D465,615 | S | 11/2002 | Brunelle | |
| D495,449 | S | 8/2004 | Kellmann | |
| 6,830,054 | B1 | 12/2004 | Ross-Kuehn | |
| 8,161,980 | B2 | 4/2012 | Inoue et al. | |
| 2002/0100489 | A1 | 8/2002 | Minnelli | |
| 2003/0116170 | A1 | 6/2003 | Nicot et al. | |
| 2004/0129285 | A1 | 7/2004 | Frazier | |
| 2006/0174905 | A1 | 8/2006 | Bias | |
| 2007/0034221 | A1* | 2/2007 | Chung | A41G 3/0016 132/53 |
| 2010/0154812 | A1* | 6/2010 | Westerman Holstijn | A41G 5/0093 132/54 |
| 2011/0186065 | A1* | 8/2011 | Inoue | A41G 5/00 132/54 |
| 2015/0013710 | A1* | 1/2015 | Buzaglo | A41G 5/0093 132/201 |
| 2015/0068546 | A1 | 3/2015 | Russell | |
| 2015/0257469 | A1* | 9/2015 | Curbeon | A41G 5/0053 132/54 |

OTHER PUBLICATIONS

PCT/EP2017/051564 International Searching Authority Report, Jan. 25, 2017.

* cited by examiner

*Primary Examiner* — Rachel Steitz
(74) *Attorney, Agent, or Firm* — Robert C. Kain, Jr.

(57) ABSTRACT

The hair band has a stretchable foundation (lateral and longitudinal) which carries a plurality of hair wefts in a brick layered pattern thereby permitting the hair wefts to move both left-right and up-down with the expanding-contracting foundation. A filament is attached to the foundation which encircles the user's head. One or two elastic members are attached between the foundation and the filament such that, when the hair band is worn, the elastic-foundation establishes a tension fit about the head of the user. Elastic elements are disposed in respective foundation tunnel cloths. The brick layered pattern of hair wefts has at least a top spaced apart weft pattern, an intermediate spaced apart weft pattern and a bottom spaced apart pattern such that respective intermediate spaces are covered by hairs falling downward.

9 Claims, 6 Drawing Sheets

HAIR BAND

The present relates to a hair band that carries either hair extensions or portions of a wig which is worn by a user.

Several different types of hair bands have been proposed in prior art systems. U.S. Patent Publication 2002/0100489 to Mannelli discloses a head band with natural hair having an elastic member which establishes a tension fit of the hair band about the head of the user. U.S. Patent Publication No. 2004/0129285 to Frazier discloses a hair extension attachment also with elastic bands. U.S. Patent Publication 2006/0174905 to Bias discloses a hair piece with a portion of the head band being elastic. U.S. Pat. No. 4,599,749 to Childs discloses a cap which carries hair and having an elastic draw string which creates folds in the back of the cap and hair extending outboard beyond the folds. U.S. Pat. No. 6,830,054 to Ross-Kuehn discloses a plurality of hair wefts which are attached to an elastic band which alternately is adopted to be worn on the head of a user. U.S. Pat. No. 8,161,980 to Inoue discloses a hair piece with an elastic band portion connected to a foundation wherein the foundation carries a plurality of hairs.

U.S. Patent Publication No. 2003/0116170 to Nicot discloses a foundation which is stretchable both laterally and longitudinally and carries a plurality of hairs. The Nicot patent disclosure also discusses a plurality of hair wefts which are mounted on the foundation. The Frazier '285 publication also discusses hairwefts. U.S. Pat. No. 3,280,826 to Jenkins discloses hair wefts attached to an elongated foundation.

OBJECTS OF THE INVENTION

It is an object of the present invention to provide a hair band which is extendable or stretchable both laterally (vertically) and longitudinally (lengthwise) and carries a plurality of hair wefts mounted on the foundation in a bricklayered pattern.

It is another object of the present invention to provide a filament which is attached via elastic members to the foundation which filament, elastic members, and foundation establish a tension fit on the head of the user (the elastic and foundation being stretchable).

It is a further object of the present invention to have the hair from the hair wefts covering intermediate spaces between the bricklayered hair weft pattern on the foundation. Stated otherwise, longitudinally aligned, but spaced apart, hair wefts define longitudinal gaps between adjacent longitudinal hair wefts. The laterally upper longitudinal run of hair wefts are transposed longitudinally away from the lower hair weft pattern such that an upper hair weft is laterally aligned with the lower longitudinal gap between the adjacent lower hair wefts. The result is a bricklayered pattern of hair wefts wherein upper hair weft pattern has hair which falls over the longitudinal gaps in the lower hair weft pattern. Coverage is provided by this bricklayered pattern of hair wefts mounted on the foundation band. Additionally, the bricklayered hair wefts move and stretch and wrinkle with the foundation band dependent upon the user's activity.

SUMMARY OF THE INVENTION

The hair band system, which is adapted to be worn on the head of a user, includes an elongated stretchable foundation band which is both laterally and longitudinally expandable. A plurality of hair wefts each carrying a plurality of hairs. These hairs are adapted to fall beyond the head of the user when the hair band is in use. The hair wefts are attached to the foundation in a bricklayered pattern which permits the hair wefts to move both laterally and longitudinally when the foundation expands or contracts or wrinkles. A filament is attached to the foundation such that both the filament and the foundation extend about the head of the user when in use. At least one elastic member is attached between the foundation and the filament. Typically, the filament is attached to the foundation band at both filament ends by an elastic element at each end. When the hair band system is worn by the user, the elastic and the foundation establishes a tension fit about the head of the user. Preferably, two elastic members are used, one at either end of said filament. Respective cloth tunnels on the foundation cover portions of these elastic elements, particularly at the respective interfaces between the elastic members and the foundation. This tunnel or closed channel reduces irritation of the user's scalp. When not in a tension fit about the head of the user, the elastic members or elements extend outboard of the tunnels. In this manner, the elastic ends are exposed.

The foundation has an upper edge and a lower edge and an intermediate segment. A first plurality of hair wefts are mounted to the upper edge of the foundation in a first spaced apart pattern. A second plurality of hair wefts are mounted to the foundation laterally (vertically) below the upper hair wefts in a second spaced apart longitudinally aligned pattern on the intermediate segment of the foundation. A third plurality of hair wefts are mounted to the lower edge of the foundation in a third spaced apart pattern. In this manner, respective intermediate spaces of the first, second and third spaced apart patterns are covered by hairs falling there over due to the brick layered pattern. In a preferred embodiment, ten (10) longitudinal runs of hair wefts are mounted on the stretchable foundation, each longitudinal run covering the lower longitudinal gaps of the lower longitudinal run of hair wefts.

BRIEF DESCRIPTION OF THE DRAWINGS

Further objects and advantages of the present invention can be found in the detailed description of the preferred embodiments when taken in conjunction with the accompanying drawings wherein.

DETAILED DESCRIPTION OF THE PREFERRED EMBODIMENTS

The present invention relates to a hair band for hair extensions or partial wigs worn by a user. The figures, which are discussed concurrently herein, have similar numerals designating similar items.

Figure 1:
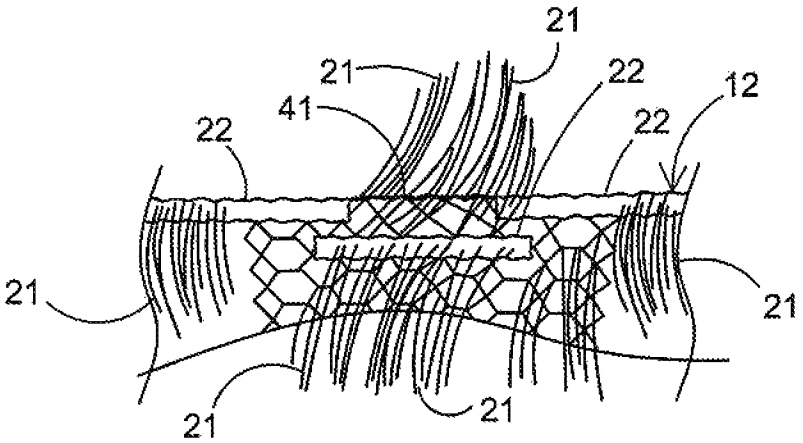
FIG. 1 diagrammatically illustrates a portion of the foundation band, a few hair wefts mounted on the foundation band, and diagrammatically illustrates some of the hairs attached to the hair wefts in the foundation and some of the hairs attached to the foundation band itself.
Figure 6:
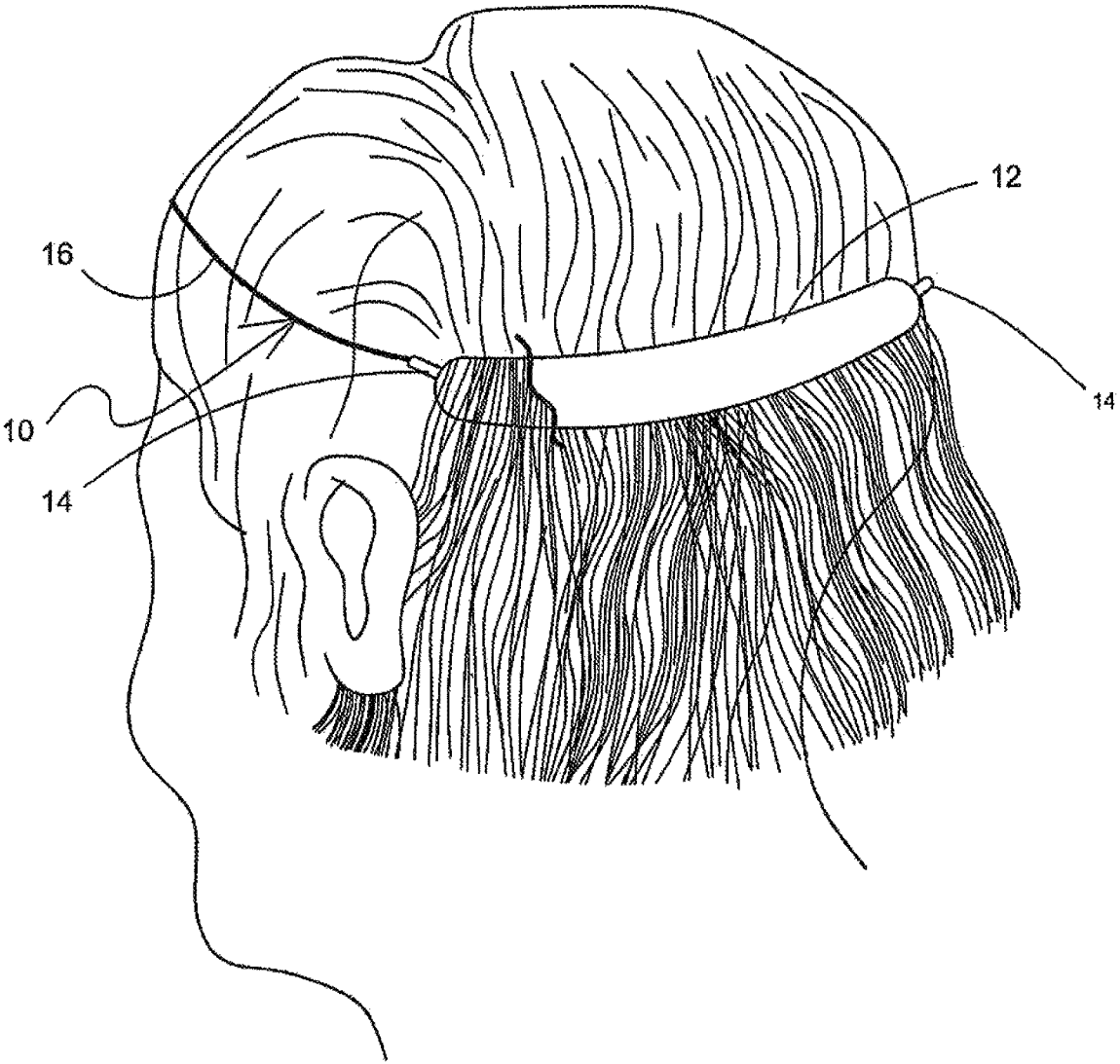
FIG. 6 diagrammatically illustrates the hair band system worn by the user.

FIG. 1 shows hair band 12, foundation band 20 and a plurality of hair wefts 22 with a large number of hairs 21 attached to the foundation 20 and attached to the hair wefts 22. FIG. 6 shows that hair band system 10 includes an elongated foundation band 12, a filament 16 and an elastic member 14. The hair band system 10 has a plurality of hair which falls beyond the head of the user. Only a small portion of the hairs are shown in all the figures.

Figure 5:
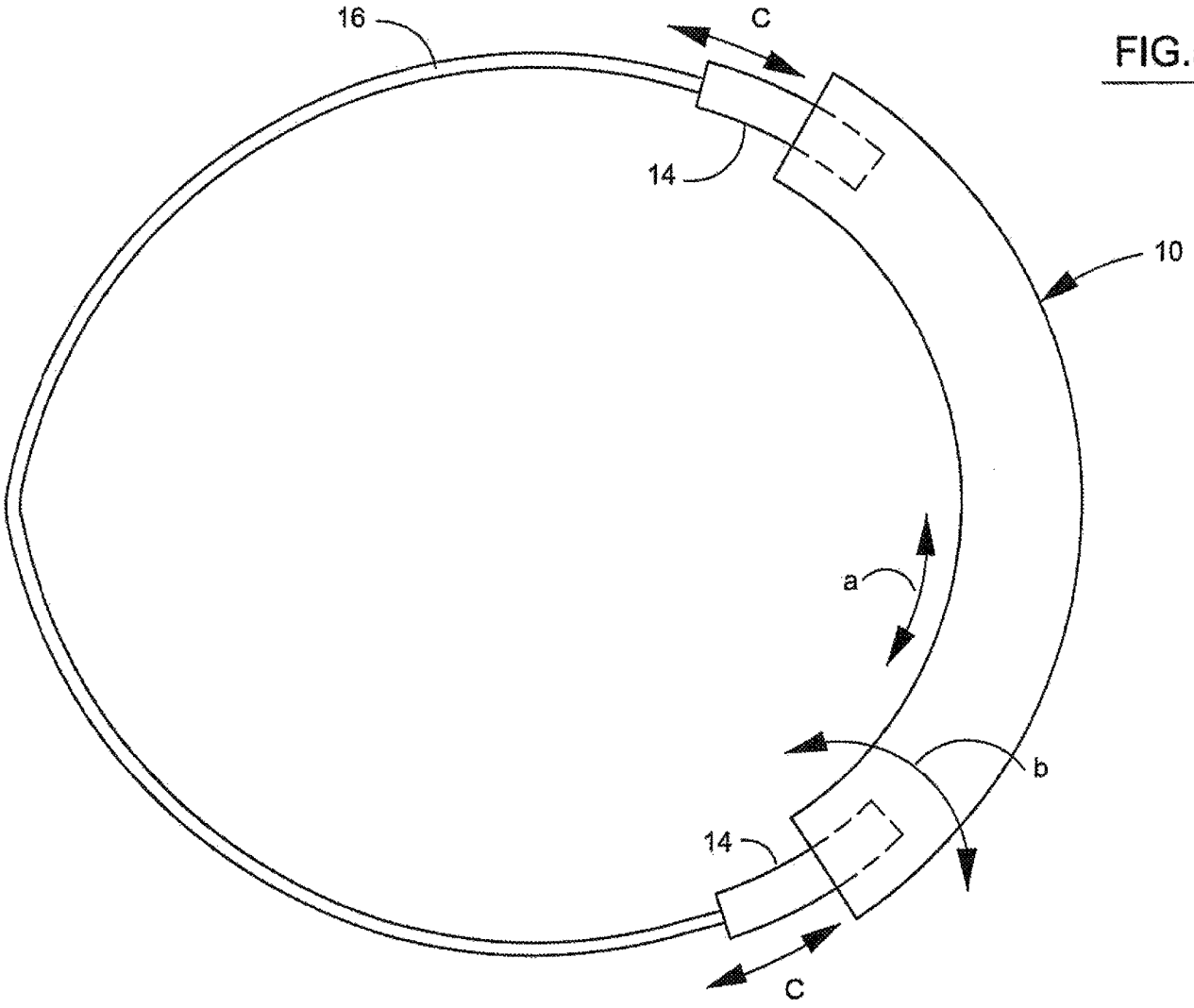
FIG. 5 diagrammatically illustrates the hair band system with the foundation band, the elastic members and the filament.

In a like manner, FIG. 1 shows only a portion of foundation band 20 of hair band system 10 (see system 10, FIGS. 5, 6). The top edge 41 of foundation 20 has a plurality of longitudinally spaced apart hair wefts 22. Each hair weft has a plurality of hairs 21 which are attached to the weft and which fall beyond the head of the user. See FIG. 6 which shows only a partial view of the hair falling off the hair band system 10.

In addition in FIG. 1, a plurality of hairs 21 are attached to top edge 41 of foundation band 20. These are hand-tied to the foundation. The longitudinal space or gap between the top left hand hair weft 22 and the top right hand hair weft 22 is longitudinally covered by a lower intermediate hair weft 22 mounted on an intermediate segment of foundation 20. A plurality of hairs 21 extend from the intermediate hair weft 22.

In addition, a plurality of hairs 21 are attached to top edge 41 of foundation 20. Further, another plurality of hairs 21 are attached at intermediate lower or lateral positions on foundation 20. In this manner, the hairs attached to the top edge 41 of foundation 20 fall down and cover the open longitudinal space and the resulting lateral space between edge 41 and the lower intermediate hair weft 22 and the intermediate foundation segment between upper edge 41 and lower edge 43. Lower edge 43 is shown in FIG. 3.

Figure 2:
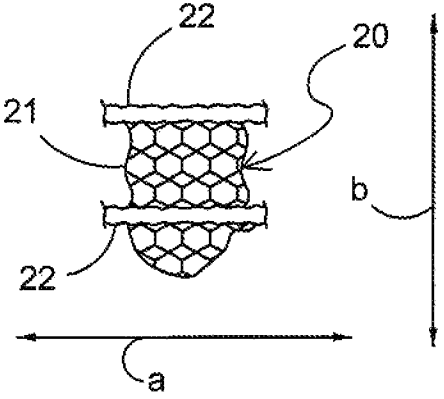
FIG. 2 diagrammatically illustrates a portion of the stretchable foundation and the lateral and longitudinal expansion—contraction and wrinkling aspect of the foundation band.

FIG. 2. diagrammatically shows a partial, detailed view of the expandable or stretchable foundation band 12 and an upper hair weft 22 and a lower hair weft 22 with foundation cells 21 therebetween. Cells 21 form the foundation band 20. The foundation is structured such that it expands and contracts longitudinally as shown by dimension a and laterally up and down as shown by dimension b.

Figure 3:
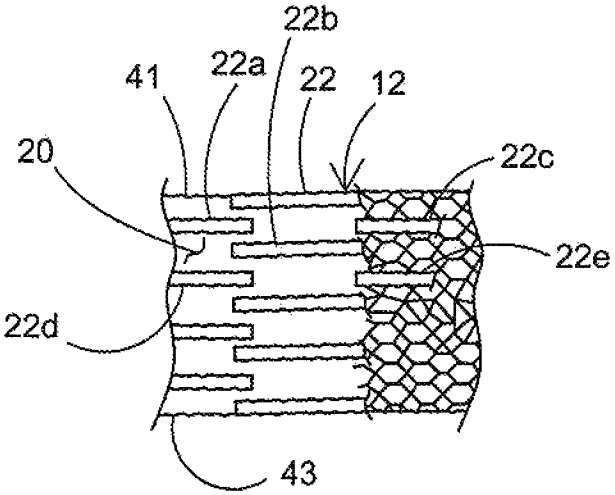
FIG. 3 diagrammatically illustrates the brick layer pattern of mounting the hair wefts on the foundation.

FIG. 3 diagrammatically illustrates the brick layered mounting pattern of the hair wefts 22 on foundation 20. Between the upper edge 41 of foundation band 20 and lower edge 43 of foundation 20, a plurality of hair wefts are mounted on the foundation. Only a portion of the foundation netting or foundation cells is shown in FIGS. 1, 2 and 3.

The brick layered hair weft pattern is established between laterally spaced apart longitudinal runs of hair wefts. Hair weft 22 in FIG. 3 is mounted on the top edge 41 of the foundation. Immediately laterally below is a longitudinally displaced, left side hair weft 22*a* and a longitudinally displaced, right side hair weft 22*c*. The intermediate longitudinal space between intermediate longitudinally spaced apart hair weft 22*a*, 22*c* is covered by hairs which extend from the upper hair weft 22. Laterally below upper hair weft 22 is a fourth hair weft 22*b*. Hair weft 22*b* spans or covers a longitudinal space between left and right hair weft 22*d*, 22*e*. Laterally below hair weft 22*b* is longitudinally displaced left hair weft 22*d* and right hair weft 22*e*. The longitudinal space between hair wefts 22*d*, 22*e* is covered by hair from the upper centrally located hair weft 22*b*. In this manner, the plurality of hair wefts establish a brick layered pattern on foundation 22. This is one of the several important features of the present invention because this brick layered pattern permits the foundation to expand and contract and adjust for wrinkles both in a longitudinal manner (left and right in connection with the head band system 10 (FIG. 6)) as well as laterally, that is up and down, in the direction b (FIG. 2).

Figure 4:
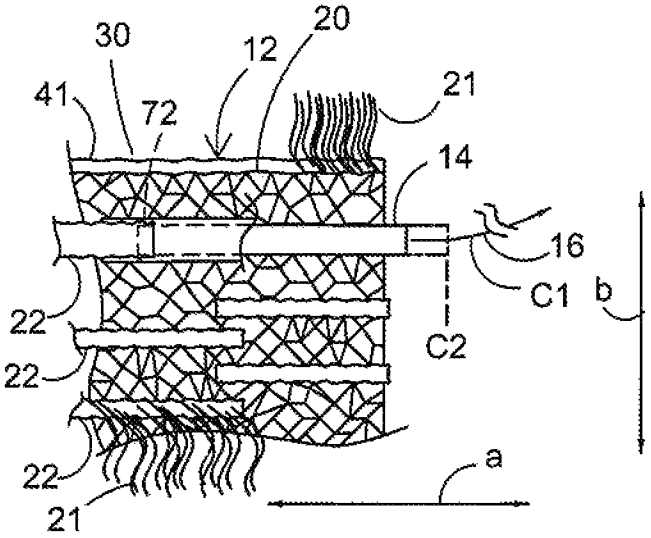
FIG. 4 diagrammatically illustrates the elastic member attached between the filament and the foundation band.

FIG. 4 diagrammatically shows a filament 16 attached at one end to elastic member 14. Elastic member 14 has an inboard end 72 that is attached to foundation 20. Elastic 14 is mounted intermediate the filament 16 and the foundation band 20. For a higher degree of support and attachment, hair weft 22 is attached to both the elastic end 72 and the foundation 20. Elastic 14 is disposed in a cloth channel or a tunnel 30. In FIG. 4, only a portion of the tunnel is shown in a broken-away view. Hairs 21 are attached to the upper edge 41 of the foundation 20. As partly shown, the lower hair weft carries a number of hairs 21.

When the hair band system is worn by the user (see FIG. 6), the elastic 14 extends outboard of tunnel 30 and filament 16 extends to extended position C2. When the elastic is at rest and not in a tension mode, only a portion of the elastic 14 extends outboard of tunnel 30. The extension mode of elastic 14 is shown in FIG. 4 as a dashed dot dashed line C2. The rest or non-tension mode is also shown as a solid line as C1. As discussed earlier, foundation 20 can move longitudinally in the direction a and can also move laterally in the direction b.

FIG. 5 diagrammatically illustrates a plain view of hair band system 10. The hair band system includes an elongated generally rectangular foundation band 12 which carries a plurality of hairs (not shown). The hair band system includes elastic elements 14 which are attached to the ends of filament 16 thereby permitting the filament to be in a tension mode about the head of the user. Longitudinal expansion is permitted in direction a and lateral expansion and contraction is permitted in direction b. The tension or rest position is shown by arrows C1, C2 in FIG. 4 and direction C in FIG. 5.

FIG. 6 shows only a portion of the hairs covering band element 12 of hair band system 10.

The claims appended hereto are meant to cover modifications and changes within the scope and spirit of the present invention.

What is claimed is:

1. A hair band adapted to be worn about the head of a user comprising:

an elongated stretchable foundation which is both laterally and longitudinally expandable;

a plurality of hair wefts, each hair weft carrying a plurality of hairs adapted to fall beyond the head of the user wearing the hair band, said hair wefts attached to said foundation in a bricklayered pattern thereby permitting said hair wefts to move both laterally and longitudinally with the foundation expansion;

a filament attached to said foundation such that both said filament and said foundation are adapted to extend about the head of the user;

two elastic members, one at either end of said filament and each elastic member connected between said filament and said foundation, said elastic members adapted to establish a tension fit about the head of the user; and respective cloth tunnels for part of said elastic elements at the respective interfaces between said elastic members and said foundation.

2. A hair band as claimed in claim 1 wherein said elastic members, when not in a tension fit, extend outboard of said tunnels.

3. A hair band as claimed in claim 1 wherein said foundation has an upper edge and a lower edge and an intermediate segment, a first plurality of hair wefts are mounted to said upper edge of said foundation in a first spaced apart pattern, a second plurality of hair wefts are mounted to said foundation in a second spaced apart longitudinally aligned pattern on said intermediate segment of said foundation, and a third plurality of hair wefts are mounted to said lower edge of said foundation in a third spaced apart pattern and wherein respective intermediate spaces of said first, second and third spaced apart patterns are covered by hairs falling there over due to the bricklayered pattern.

4. A hair band adapted to be worn about the head of a user comprising:

an elongated stretchable foundation which is both laterally and longitudinally expandable;

a plurality of hair wefts, each hair weft carrying a plurality of hairs adapted to fall beyond the head of the user wearing the hair band, said hair wefts attached to said foundation in a bricklayered pattern thereby permitting said hair wefts to move both laterally and longitudinally with the expandable foundation;

a filament attached to said foundation, said filament and foundation combination adapted to encircle the head of the user;

two elastic members, one at either end of said filament and each elastic member connected between said filament and said foundation, said elastic members adapted to establish a tension fit about the head of the user; and respective cloth tunnels for said elastic elements at the respective interfaces between said elastic members and said foundation.

5. A hair band as claimed in claim 4 wherein said elastic members, when not in a tension fit, extend outboard of said tunnels.

6. A hair band as claimed in claim 4 wherein said foundation has an upper edge and a lower edge and an intermediate segment, a first plurality of hair wefts are attached to said upper edge of said foundation in a first spaced apart pattern, a second plurality of hair wefts are attached to said foundation in a second spaced apart longitudinally aligned pattern on said intermediate segment of said foundation, and a third plurality of hair wefts are attached to said lower edge of said foundation in a third spaced apart pattern and wherein respective intermediate spaces of said first, second and third spaced apart patterns are covered by hairs falling there over due to the brick layered pattern.

7. A hair band adapted to be worn about the head of a user comprising:

an elongated stretchable foundation which is both laterally and longitudinally expandable;

a plurality of hair wefts, each hair weft carrying a plurality of hairs adapted to fall beyond the head of the user wearing the hair band, said hair wefts attached to said foundation in a bricklayered pattern thereby permitting said hair wefts to move both laterally and longitudinally with the foundation expansion;

a filament attached to said foundation such that both said filament and said foundation are adapted to extend about the head of the user;

at least one elastic member attached between said foundation and said filament which is adapted to establish a tension fit about the head of the user;

a tunnel over a portion of said at least one elastic element at the interface between said elastic members and said foundation.

8. A hair band as claimed in claim 7 wherein said at least one elastic member, when not in a tension fit, extend outboard of said tunnel.

9. A hair band as claimed in claim 7 wherein said foundation has an upper edge and a lower edge and an intermediate segment, a first plurality of hair wefts are mounted to said upper edge of said foundation in a first spaced apart pattern, a second plurality of hair wefts are mounted to said foundation in a second spaced apart longitudinally aligned pattern on said intermediate segment of said foundation, and a third plurality of hair wefts are mounted to said lower edge of said foundation in a third spaced apart pattern and wherein respective intermediate spaces of said first, second and third spaced apart patterns are covered by hairs falling there over due to the bricklayered pattern.

* * * * *